United States Patent [19]

Goetz et al.

[11] Patent Number: 4,549,932

[45] Date of Patent: Oct. 29, 1985

[54] APPARATUS AND PROCESS FOR A DECURLING SYSTEM

[75] Inventors: William J. Goetz, Appleton; Thomas G. Engel, Menasha, both of Wis.

[73] Assignee: Appleton Papers, Inc., Appleton, Wis.

[21] Appl. No.: 257,947

[22] Filed: Apr. 27, 1981

[51] Int. Cl.[4] ..... D21F 11/00

[52] U.S. Cl. ..... 162/207; 162/271

[58] Field of Search ..... 162/197, 207, 270, 231

[56] References Cited

U.S. PATENT DOCUMENTS

| | | | |
|---|---|---|---|
| 3,467,541 | 9/1969 | Aronsson et al. | 162/207 |
| 3,938,261 | 2/1976 | Anderson | 162/207 |
| 4,207,143 | 6/1980 | Glomb et al. | 162/207 |
| 4,249,992 | 2/1981 | Wells | 162/207 |

*Primary Examiner*—Peter Chin

*Attorney, Agent, or Firm*—Birch, Stewart, Kolasch & Birch

[57] ABSTRACT

An apparatus and process are disclosed for an efficient decurling system wherein a web material is introduced into a steam environment such that the distance between the web and the steam source is maintained substantially constant.

8 Claims, 3 Drawing Figures

APPARATUS AND PROCESS FOR A DECURLING SYSTEM

BACKGROUND OF THE INVENTION

This invention relates to a decurling operation and more specifically to a steam shower decurling system which is markedly more efficient and effective in achieving improved decurling capacity than traditional steam shower operations.

As is commonly known, when a web material is supplied in the form of a roll there is an initial curl in the web depending on such factors as the length of time the roll has been stored in stock and variation in the roll diameter, such as the curvature of the different convolutions making up the roll. In order to compensate for these influences on the straightness of a web, it has been found necessary to provide certain prescribed treatments to straighten the web material such as described in U.S. Pat. Nos. 3,185,616 and 3,649,447, so that when it is ultimately cut into sheets, the handling of the sheets may be facilitated and the undesirable curling effect eliminated. While these existing devices for straightening webs have been found useful, they have not been altogether satisfactory in the sense that they are expensive and/or require complicated mechanisms.

In the case of paper, it is known that increasing the moisture content of the paper will lead to less trouble from curling than paper having a lower moisture content. With respect to a coated sheet, for example, it is known that the latter will tend to curl towards the last side coated, and thus moisture is applied to the side opposite to which the sheet otherwise would tend to curl. Thus, as regards the paper industry, the controlled and uniform application of moisture to raw stock and/or coated webs is a goal of distinct importance.

Several methods have been proposed for applying moisture to a moving sheet or web. Examples of these include roll applicators such as the Dahlgren-type systems, electrostatic systems such as disclosed in U.S. Pat. No. 3,467,541 and steam shower devices. Other examples for adding moisture to a web include a method and apparatus for applying steam to and condensing moisture on a web that is backed by a heat conducting body, as disclosed in U.S. Pat. No. 2,370,811 and a device that directs a humid atmosphere towards the web, as disclosed in U.S. Pat. No. 3,238,635.

While these and other techniques have been found useful in applying moisture to a paper work piece so as to minimize the undesirable curling properties of the paper, there have been found inherent disadvantages in their use. In one instance for example, condensation of steam vapor on the web is produced because the web is backed by a heat sink or metal roll through which a cooling fluid is passed. In the case where humid atmosphere is directed toward the web the system has proven to be inefficient. Furthermore, in the case where steam showers are employed directly, decurling has been strictly governed by the steam pressure employed at the shower head. Lack of effective decurling lead to the utilization or reliance upon excessive steam pressure and/or reduced machine speeds. A change in pressure has been demonstrated to have an effect on other important variables such as the web temperature, web-to-shower distance and steam billowing. In addition, decurling regulated by steam pressure alone is uneconomical and inefficient. With a free floating web, a high level of exhaust is required to counter the rise in web-to-shower distance and to control the billowing effect resulting from the additional steam usage, the increased amount of steam required due to steam, which is essential to decurling, being drawn away by the exhaust. The resulting lack of decurling capacity leads to costly limitations on both quantity and quality.

SUMMARY OF THE INVENTION

It is, therefore, an object of the present invention to provide a steam decurling system for a web material, such as a coated paper stock, which will overcome the above noted disadvantages.

It is a further object of the present invention to provide a steam decurling configuration which stabilizes the web material in the vicinity of the site of steam emission.

It is another object of the present invention to provide a steam decurling apparatus and process which effectively regulates the distance of the web material to the steam shower under variable operating conditions.

Another object of the present invention is to provide a steam decurling system which eliminates fluttering of the treated web material to produce a more uniform steam application and penetration.

Yet, still a further object of the present invention is to provide a decurling configuration wherein the area about the steam shower is confined so as to closely control the billowing effect produced by the steam with minimal exhaust.

Yet, another object of the present invention is to provide an effective decurling operation while substantially reducing the amount of normal steam pressure required during the process.

The foregoing objects and others are accomplished in accordance with the present invention generally speaking, by providing a steam decurling system wherein a paper web, or the like, is driven through a steam shower environment for purposes of increasing the moisture content of the web material. The steam showers are emitted from a source, such as a steam pipe, from beneath the surface of the web material. Positioned above the web and spaced therefrom is at least one fixed stabilizing assembly so designed to effectively control and regulate the distance of the web-to-steam shower source under variable operating conditions. By carefully controlling the distance between the web material and the source of the steam, the deposit of the steam on the web surface is more uniform and the resulting decurling effect more dynamic. It is preferred that the stabilizer, when the configuration is compatible, be positioned just prior to the outlet for the steam from the respective steam source. The above described method and configuration provide for a close regulation of those factors which have the most influential effect upon a decurling operation.

It has been determined in the course of the present invention that the factors found to be most significant in controlling the curling effect related to paper technology and more specifically to the fabrication of coated paper webs are the web-to-moisture source distance, web temperature, steam pressure and exhaust level. By implementing the system of the present invention, the regulation of these factors has been effectively achieved. The configuration of the present invention provides for reliable control of the distance between the web material and the source of the steam shower which effectively eliminates the fluttering effect resulting from excessive steam pressures applied, producing a more uniform, steam application and penetration. By confining the area about the steam shower, the billowing effect produced by the steam, under pressure, is minimized thus eliminating the necessity of extreme exhaust conditions.

BRIEF DESCRIPTION OF THE DRAWINGS

The invention is further illustrated by way of the accompanying drawings wherein.

DETAILED DESCRIPTION

Figure 1:
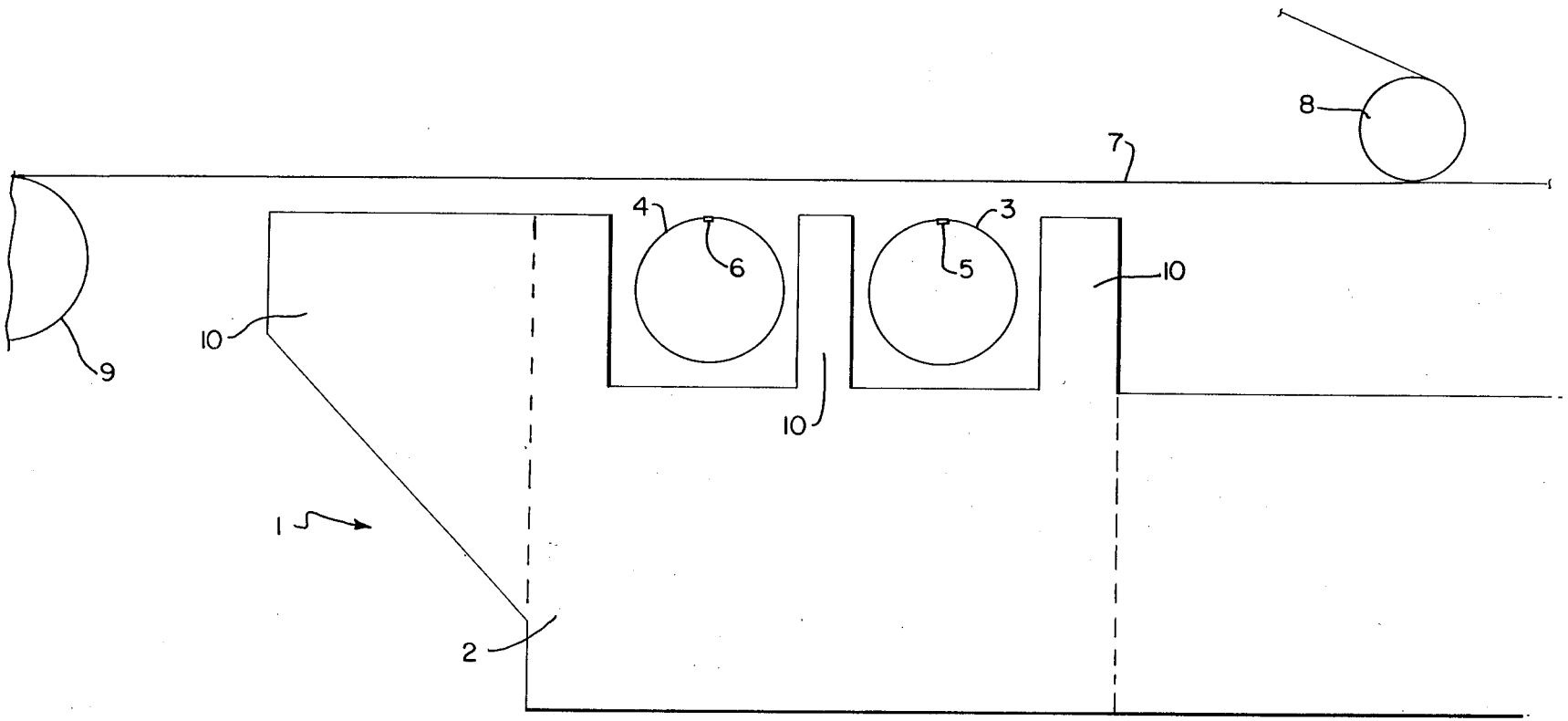
PRIOR ART FIG. 1
FIG. 1 represents a conventional steam shower decurling configuration and FIGS. 2 and 3 represent the steam shower decurling system of the present invention.

Referring now to FIG. 1 there is seen a steam shower decurling structure generally designated 1 consisting of a steam shower housing 2 and the sources of steam represented herein as two steam pipes 3 and 4 with related orifices 5 and 6. A web material 7 from feedroll 8 passes above the steam pipes 3 and 4 and is taken up on idle roll 9. Exhaust chambers 10 are provided for removal of excess steam. In the instant illustration decurling is regulated by steam pressure alone with a free-floating web. Under these conditions, the steam pressure applied adversely effects the resulting web-to-steam shower distance and leads to excessive steam billowing. In order to counter this effect, high level exhausting is implemented which leads to excessive removal of steam by the exhaust system therefore requiring a step up in steam usage.

Figure 2:
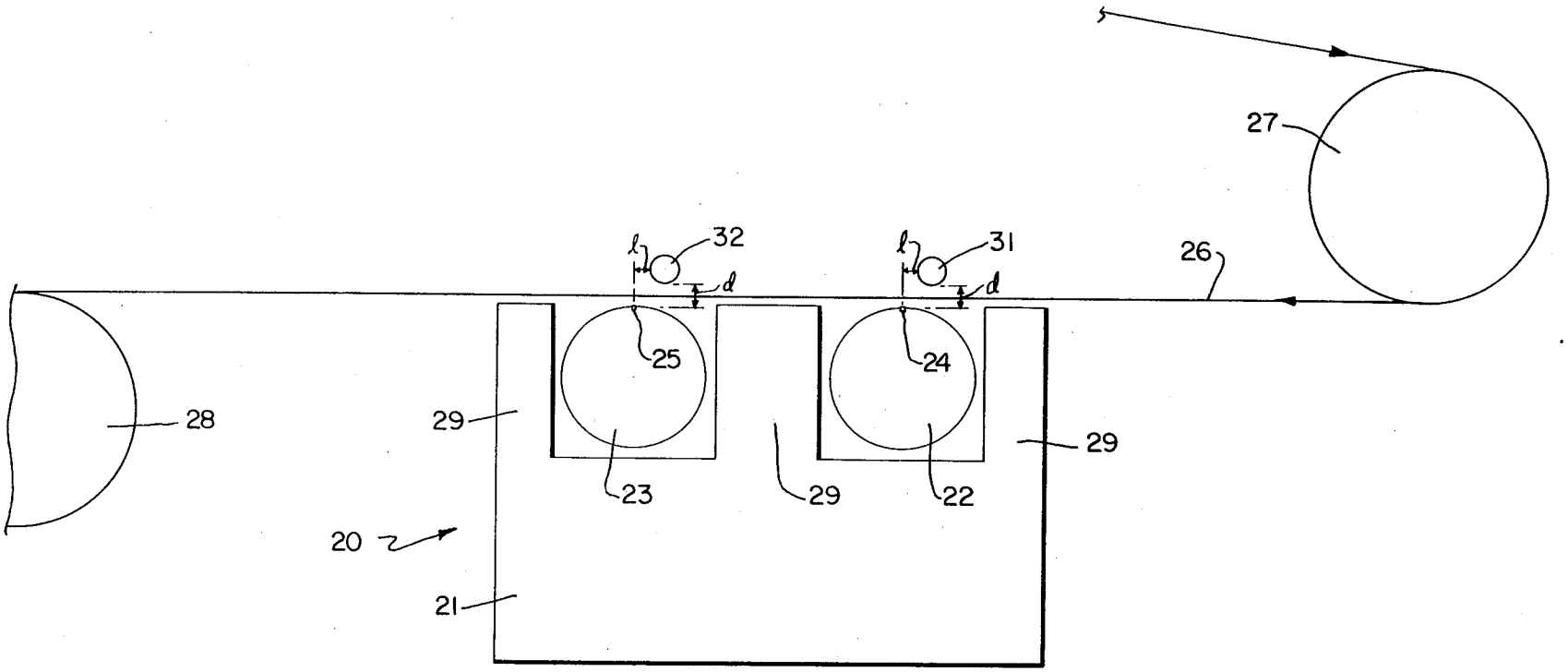

In FIG. 2 is seen the steam decurling unit of the present invention generally designated 20 comprising a steam shower housing 21 containing steam sources, herein represented as steam pipes 22 and 23. Steam showers are emitted from the steam pipe orifices 24 and 25, respectively. The web sheet 26 from feed roll 27 is introduced above the steam pipes 22 and 23 to take-up roll 28. Exhaust vents 29 are provided for controlled venting of the billowing steam emitted from the respective steam pipes. Positioned above the web material 26 are rollers 31 and 32 which are mounted above the steam shower sources staggered in such a way so as to be offset from the orifices of the respective steam pipes. Generally, the roll-to-steam pipe distance (d) is maintained at about $\frac{3}{4}''$. During the moistening process the rolls selectively contact the upper surface of the web material thus maintaining a constant web-to-shower source distance, eliminating fluttering, and confining the area about the steam showers, thus permitting control of the billowing steam with minimal use of the exhaust system. Offsetting the rolls so as not to be placed immediately above the respective orifices minimizes any web damage that might occur at excessive steam pressure i.e. beyond 25 pounds of pressure. For purposes of the present invention the rolls are found to be most effective when mounted at positions (1) and that the leading surface of the respective roll is about $\frac{1}{2}''$ prior to the respective steam pipe orifice emitting the steam shower. When the moisture is uniformly applied to a coated web or paper sheet, the web is fed in a manner such that the moisture is applied to the side opposite to which the coating was last applied.

Figure 3:
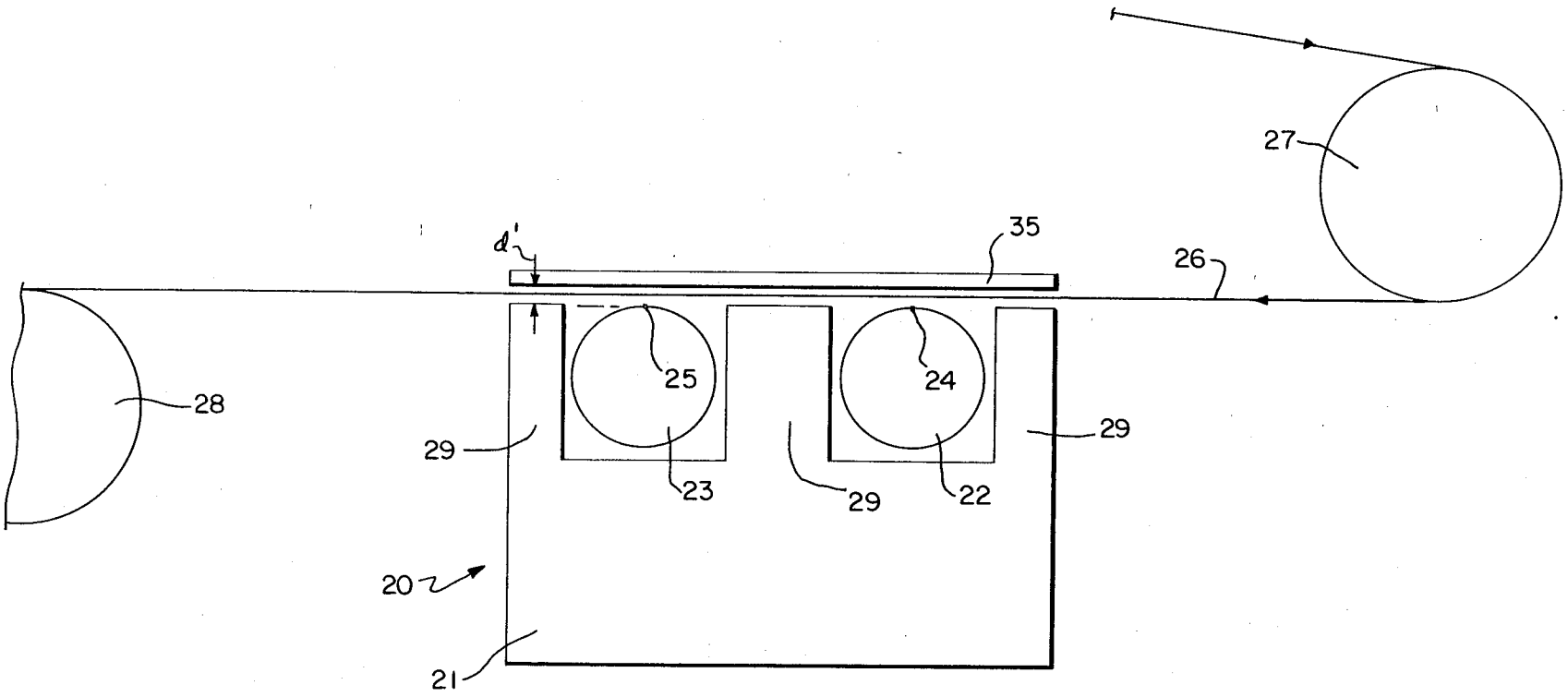

FIG. 3 represents an alternate embodiment of the present invention wherein corresponding elements of the steam decurling apparatus of FIG. 2 have like numerical identifications. Plate 35 replaces the rolls 31 and 32. The plate is mounted above the steam shower coater, with the most effective results being obtained with the plate-to-shower distance (d') being about $\frac{3}{4}''$ or less. Any suitable structural plate may be used such as aluminum and chromium-plated and teflon-coated plates, depending upon the surrounding circumstances and conditions of application.

Although the present invention has been discussed in terms of utilizing rolls or a plate for maintaining the constant distance between the web and the steam shower source, any suitable such device may be utilized which produces the same results desired. Again, the presence of the plate above the treated web material confines the area about the shower, controls the web to shower distance, and eliminates fluttering. However, inasmuch as the plate, during practice, substantially contacts the entire coated surface of the web material, it is obviously preferred that the roll structure be utilized in practicing the present invention. However, both the roller and plate configurations produce the web stabilizing effect which is necessary in order to achieve the desired moistening properties of the web material to provide the desired decurling process.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A steam decurling apparatus which comprises means for introducing a web material into a moistening environment, means for providing steam showers to at least one surface of said web material and means for restricting and stabilizing said web material, said stabilizing means positioned opposite said steam shower means so as to confine the area of the steam shower and web material to maintain a substantially constant distance of about $\frac{3}{4}''$ or less between said web material and source of steam showers while applying minimal contact to said web material.

2. The apparatus of claim 1 wherein said steam shower means comprises at least one steam pipe means having a steam emitting orifice located at the center line of said pipe beneath said web material which directs steam showers onto the surface of said web material and said stabilizing means comprises at least one roll configuration positioned opposite said steam pipe means such that the leading surface of the respective roll is positioned about $\frac{1}{2}''$ prior to said steam emitting orifice of said respective steam shower pipe means.

3. The apparatus of claim 1, wherein said steam shower means comprises at least one steam pipe means having a steam emitting orifice located at the center line of said pipe beneath said web material which directs steam showers onto the surface of said web material and said stabilizing means comprises a plate positioned above said web material.

4. A process of uniformly applying moisture to a web material which comprises introducing said web material into a confined zone having at least one steam source located beneath said web and a stabilizing unit positioned above said web opposite said at least one steam source, subjecting the underside of said web material to a steam shower so as to effectively impregnate and moisten said web material while maintaining the distance between said steam shower source and the underside of said web material substantially constant at about $\frac{3}{4}''$ or less.

5. The process of claim 4 wherein said stabilizing unit is positioned about $\frac{1}{2}''$ prior to the localized source of said steam shower.

6. The process of claim 5 wherein said steam source comprises a steam pipe means having a steam emitting orifice located at the center line of said pipe and said stabilizing unit comprises at least one roll configuration corresponding to each of said steam pipe means.

7. The process of claim 4 wherein said steam showers are provided by at least one steam pipe means positioned beneath said web material having steam emitting orifices located at the center line of said pipe and said stabilizing unit comprises a plate juxtapositioned above said web material.

8. The process of claim 4 wherein said web material comprises a coated paper sheet.

* * * * *